United States Patent [19]

Watanabe

[11] 4,202,545

[45] May 13, 1980

[54] GOLF GAME DEVICE

[75] Inventor: Hiroyuki Watanabe, Tokyo, Japan

[73] Assignee: Tomy Kogyo Co., Inc., Tokyo, Japan

[21] Appl. No.: 920

[22] Filed: Jan. 4, 1979

[51] Int. Cl.[2] ..... A63F 7/06

[52] U.S. Cl. ..... 273/87 R; 273/85 R; 273/176 L

[58] Field of Search ..... 273/87 R, 87.2, 87.4, 273/237, 245, 85 R

[56] References Cited

U.S. PATENT DOCUMENTS

| | | | |
|---|---|---|---|
| 3,068,009 | 12/1962 | Quackenbush et al. | 273/87 R |
| 3,617,064 | 11/1971 | Collup | 273/87 R |
| 3,638,944 | 2/1972 | McQueen | 273/87 R |
| 3,871,650 | 3/1975 | Casey | 273/87 R |
| 4,130,280 | 12/1978 | Lowell | 273/87.2 |

*Primary Examiner*—George J. Marlo
*Attorney, Agent, or Firm*—Staas & Halsey

[57] ABSTRACT

A simulated golf game playing structure for two players comprising a support housing having a relatively large viewing aperture provided therein and a plurality of manually player controlled mechanisms readily accessible thereon, a pair of spools rotatably supported therein at substantially opposite ends thereof, an electric motor, a reversible drive mechanism between the electric motor and the pair of spools, a flexible program tape supported on and between the pair of spools for bidirectional movement of the program tape, the program tape having golf scenes such as green driving tee spots and green scoring holes and slots in the program tape provided in alignment with each green scoring hole, an electric bulb positioned beneath the program tape, electric switch contacts associated with the tape and the slots therein for effecting energization of the electric bulb whenever a simulation of a golf ball scoring in a hole occurs, a golf ball replica movably mounted over the program tape and mounted so as normally to be in alignment with respective green driving tee spots and scoring holes when in a normally at rest first position, player operated actuating mechanism for effecting the movement of said golf ball replica, semi-automatic mechanism simultaneously actuatable by the player operated mechanism for effecting energization of the electric motor for a short period of time which varies with the amount of manual input by a player of the device, manual mechanism connected to the spool drive mechanism for player control of the direction of program tape movement, and two manually operated scoring mechanisms mounted on the housing for separate player recording of their respective individual scores as compared with a preindicated par for each particular golf scene.

11 Claims, No Drawings

FIG. 3.
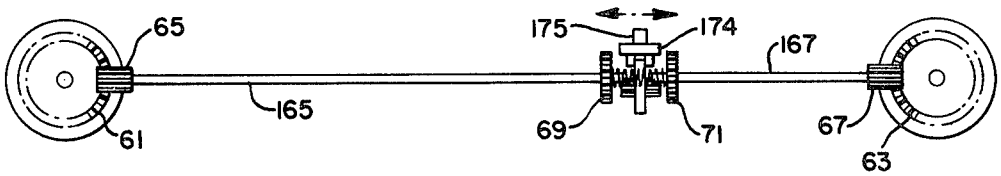
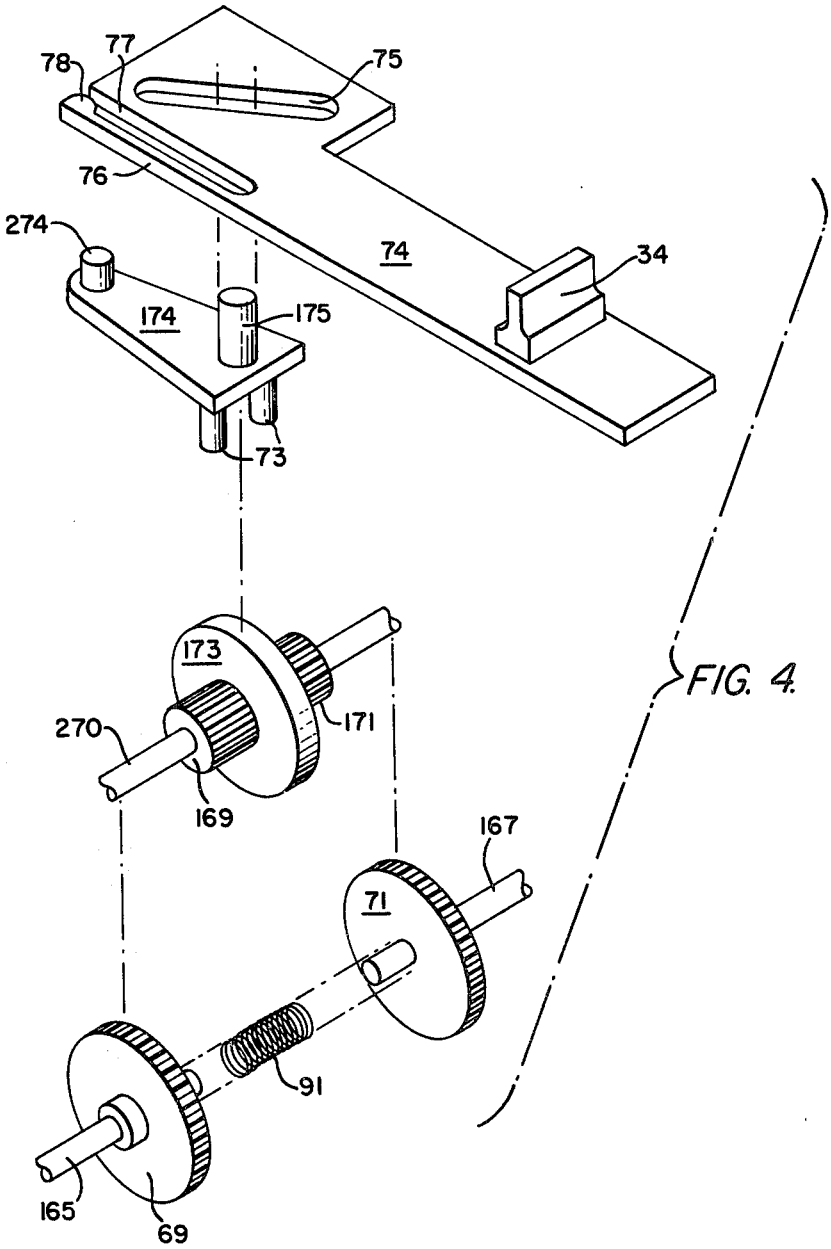
FIG. 4.

152
150
144
142
158
146
148
156
152
143
159
157
114
322
118
116
243
343
112
96
94
114
112
110
296
220
298
222
98
198
214
214
14

GOLF GAME DEVICE

BACKGROUND OF THE INVENTION

The present invention relates to a golf game device permitting a wide variety of simulated golf playing functions to be performed by one or more players. With the game device of this invention, a player can control the direction of movement of a simulated background scene of a golf green having a plurality of driving tee spots and scoring holes thereon. The various scenes are depicted on a flexible program tape which moves past a viewing window of the device. A player can effect either a forward or backward movement of the program tape. Also a replica of a golf ball is mounted for swinging movement on a pivoted lever which in turn is player actuated by a manually controlled and spring biased simulated drive shot lever.

Semiautomatic switch mechanism is provided for simultaneously energizing with each "shot" of the golf ball replica an electric motor to drive actuating mechanism for the movable tape in order to effect a simulated drive of the golf ball over a varying distance as controlled by the semiautomatic switch mechanism.

A manually operated slide to control the forward and backward direction of the tape actuating mechanism is provided, as well as score keeping mechanism for two players.

An object of the present invention is to provide an easily playable game which substantially simulates in many respects a real game of golf with the game device being relatively lightweight, easily portable, energizable by self contained batteries and relatively inexpensive.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a front elevational view of the winding, unwinding mechanism of FIG. 2;

FIG. 4 is an exploded perspective view of the reversing gear shift mechanism for the winding and unwinding mechanism;

DESCRIPTION OF THE PREFERRED EMBODIMENT

Figure 1:
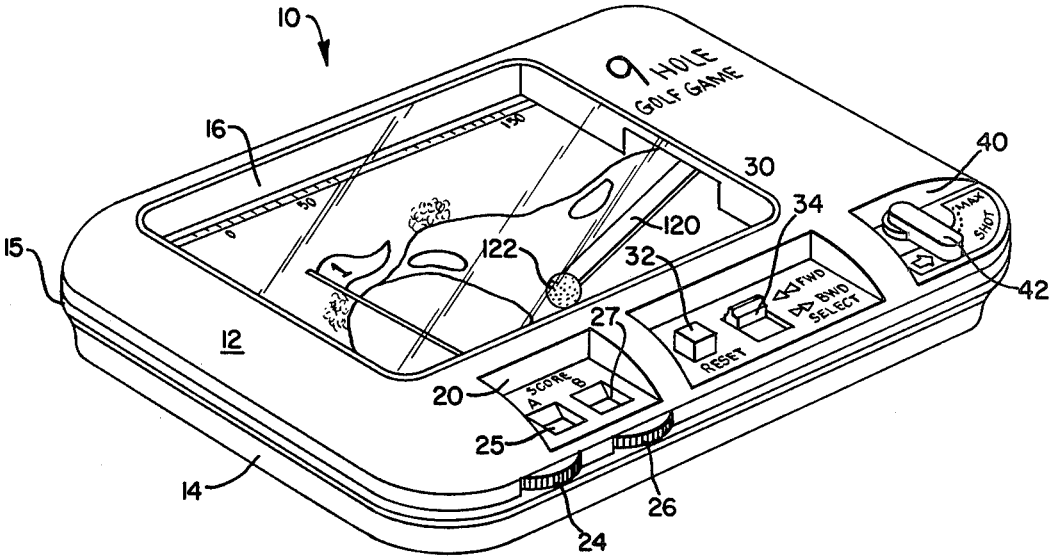
FIG. 1 is a perspective view of the golf game device of this invention.

Looking at FIG. 1 of the drawings, reference numeral 10 indicates in general the golf game device of this invention. An upper housing container 12 mates with a lower housing container 14 along a junction line 15. Normally the upper and lower housing containers are made of plastic and provided with interfitting portions for mating along junction line 15. The upper housing container 12 is provided with a relatively large window aperture 16 covered by a transparent sheet of plastic or the like. Recesses 20, 30 and 40 are appropriately formed in the upper housing container for various player operated mechanisms. In recess 20 Score mechanisms are provided. A first score disc 24 viewable through a small aperture 25 permits one player to keep track of the simulated golf swings relative to an indicated par for the course being played. Similarly, a second score disc 26 viewable through window 27 permits a second player to keep track of his score.

In the recess 30, a manually operable Reset button 32 is provided for permitting a player to energize the electric motor of the device, and/or move the program tape of the device in one direction or the other without simulating any swing of a golf club and/or drive of the golf ball replica. A button 34 permits manual selection by a player of either forward or backward movement of the program tape of the device.

In recess 40, a trigger lever 42 is provided for manual actuation of the simulated golf club swing and golf ball drive of the device. Normally appropriate indicia is provided on the housing container 12 adjacent the respective player operated controls to indicate the proper movement and control function. For example, recess 40 on the adjacent surface has the term Shot near trigger lever 42 with Max for indicating maximum power of the golf club swing. Similarly, recess 30 has the term RESET, SELECT, FWD and BWD, along with appropriate direction arrows indicated thereon. Recess 20 has SCORE indicated thereon as well as player 1 and 2, or A and B.

Figure 2A:
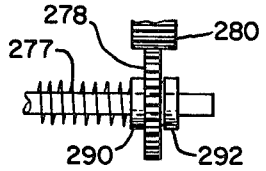
FIG. 2A is an enlarged view of the friction slip clutch, which is encircled in FIG. 2
Figure 2:
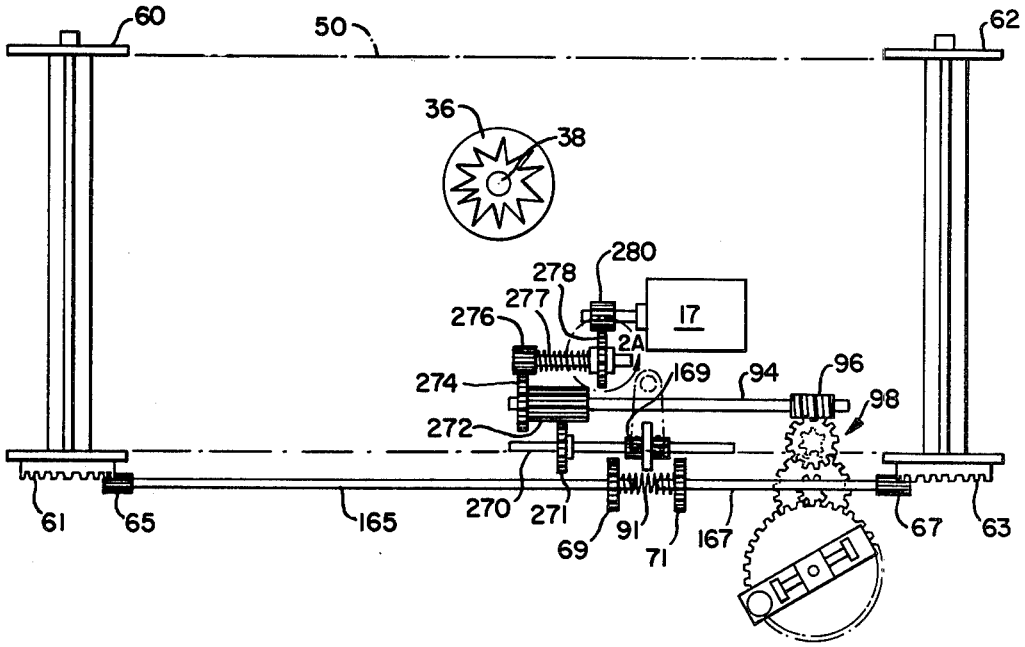
FIG. 2 is a top plan view of the flexible web program tape winding and unwinding mechanism.

Looking at FIGS. 2 and 3, the winding mechanism for driving the pair of supply/takeup spools 60 and 62 is shown. Also shown in FIG. 2 is a scoring signal indicator light bulb 38 with light concentrating housing 36. Housing 36 is provided with a serrated or toothed opening at the top thereof for giving a "burst of light" effect when the bulb 38 is energized. The spool 60 has integral therewith at one end teeth 61 for engagement with a pinion 65. Pinion 65 is in turn connected by drive shaft 165 to drive gear 69. The other spool 62 similarly has integral therewith teeth 63 mating with pinion 67, connected by shaft 167 to drive gear 71. A small connecting torsion spring 91 is provided between the two respective spool drives to maintain suitable tension on the flexible tape 50 as wound between and upon the respective spools 60, 62, one end of spring 91 being attached to gear 69 and the other end to gear 71.

As best seen in FIG. 4, driving pinion and shift mechanism is provided so as to energize one spool or the other of the respective spools 60, 62. A driven shaft 270 supports drive pinions 169 and 171 together with a separating and shifting disc 173. The shifting disc 173 is loosely engaged by the shifting pins 73 depending from shift plate 174. Shift plate 174 is pivotally mounted by a short pin 274 at one end thereof, and has a longer projecting pin 175 at the other end thereof for mating with a shift slot 75 provided in slideable shift plate 74. The slideable shift plate 74 is player actuated by knob 34 secured thereto.

As can be seen by looking at the various views, when a player moves the knob 34, which extends from the upper housing container as shown in FIG. 1, the slide plate 74 will be moved to effect shifting on the shift disc 173 by means of the pins 73. This effects a shifting of the drive pinions 169 or 171 into engagement with either driven gear 69 or 71, respectively, for effecting a change in moving direction of tape 50.

Figure 5:
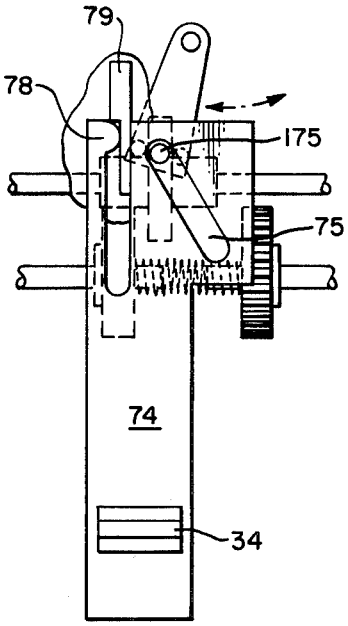
FIG. 5 is a top plan view of the shift control plate of the reversing mechanism of FIG. 4 in a first position.
Figure 6:
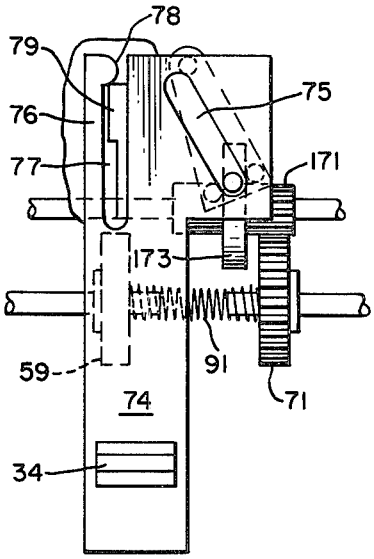
FIG. 6 is a top plan view of the shift control plate in a second position.

As best seen in FIG. 2, the shaft 270 is driven by means of attached gear 271 from pinion 272 integral with gear 274 and fixed to shaft 94. Shaft 94 also has secured thereto a worm gear 96 for drive of the semiautomatic actuating mechanism for the motor switch as described below. The gear 274 is in turn driven from pinion 276 by means of a friction slip clutch gear 278. Spring 277, between pinion 276 and disc 290, maintains driving engagement against the gear 278 and disc 292 as best seen in FIG. 2A. A motor pinion 280 is appropriately secured to the output shaft of the electric motor 17. Thus, as can be easily visualized, every time the electric motor 17 is energized, a positive friction drive will be provided for one or the other of the spools 60, 62, depending on which direction the shift lever 34 has been oriented. However, the friction slip clutch (FIG. 2A) will prevent motor damage in case of some malfunction of the rest of the mechanism. In order to insure that the shift slide 74 will stay in one of the two end positions thereof, i.e., either FWD or BWD, for forward and backward, respectively, the shift slide 74, as best seen in FIGS. 4, 5 and 6, is provided with another slot 77 which provides a flexible arm 76 with an outstanding protrusion 78 thereon. When the shift slide 74 is mounted on the structure of the lower container housing 14, an appropriate stop projection 79 meets with and engages with the protrusion 78. Thus, as seen in FIG. 5, the protrusion 78 will engage the lower stop portion of projection 79 to retain the slide in the backward position, or as seen in FIG. 6, the protrusion 78 will engage with the upper left corner of the projection 79 to retain the slide in the forward position. The winding mechanism drive pinions 169 and 171 also can be seen together with the shift mechanism drive gears 69 and 71 in these views.

Figure 7:
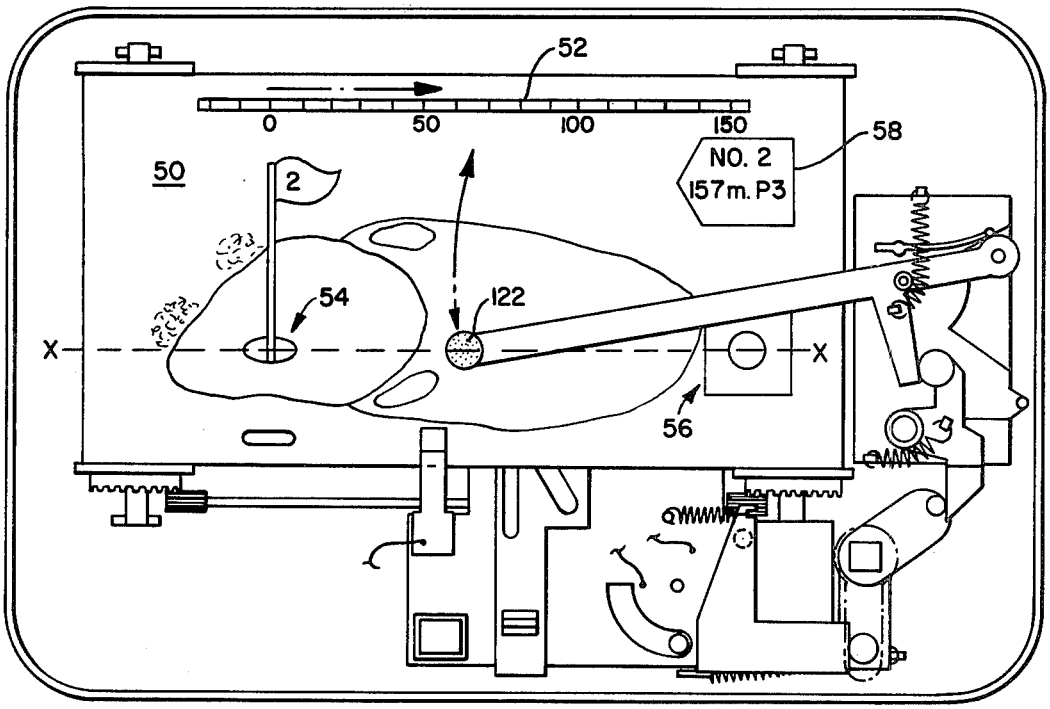
FIG. 7 is a top plan view of the game device mechanism with the upper container portion of the housing removed.
Figure 11:
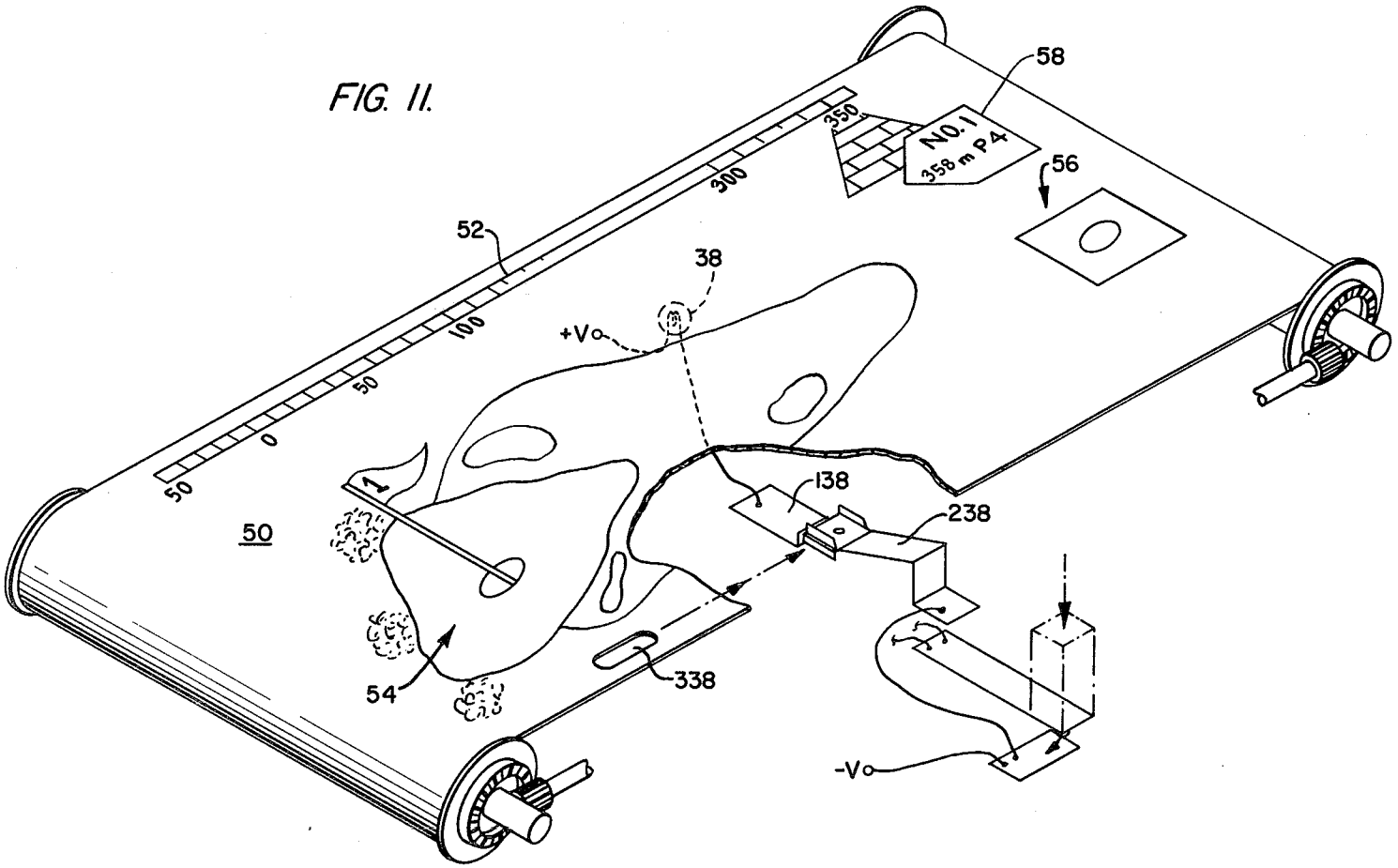
FIG. 11 is a perspective view of the flexible web program tape with slot actuated switch and scoring signal indicator circuit.

As best seen in FIGS. 7 and 11, the program tape comprises a flexible web member 50 having depicted thereon scenes of a golf course including as a minimum; a plurality of individual green scoring holes 54, and associated driving tee spots 56. Each respective hole combination, i.e., a swing hole with a driving tee spot, is normally positioned, as indicated by X—X in FIG. 7, to align with a golf ball replica 122 mounted on a swingable pivoted member 120 when in the rest position. Also normally provided on the program tape along one edge thereof are preprinted indicia of distances such as 0, 50, 100, etc., up to 350 or so for distances in meters (or yards). This indicia 52 gives a player some indication as to the distance the golf ball replica moves after a simulated drive by a player is inputted the device. Normally associated with each golf scene are information blocks 58. For example, in the view of FIG. 7, the information block 58 indicates that hole 2 is being played, the distance between the driving tee spot 56 and the scoring hole 54 is 157 meters, and par for this hole of the overall course is 3. Similarly, in FIG. 11, hole 1 is being played with the distance between the driving tee spot and the scoring hole being 358 meters, and par for this hole is 4. The game program tape is preferably provided with nine (9) holes therein.

Shown by dotted lines in FIG. 11, the score signal indicating light bulb 38 is connected to switch contacts 138, 238. The switch contacts 138, 238 are normally separated by an edge of the program tape passing therebetween, but upon a scoring hole being positioned in alignment with the switch contacts, an appropriate slot 338, shown just below the scoring hole (number 1 in this scene), permits the contacts to close and thus energize light bulb 38 to indicate a score.

Figure 8:
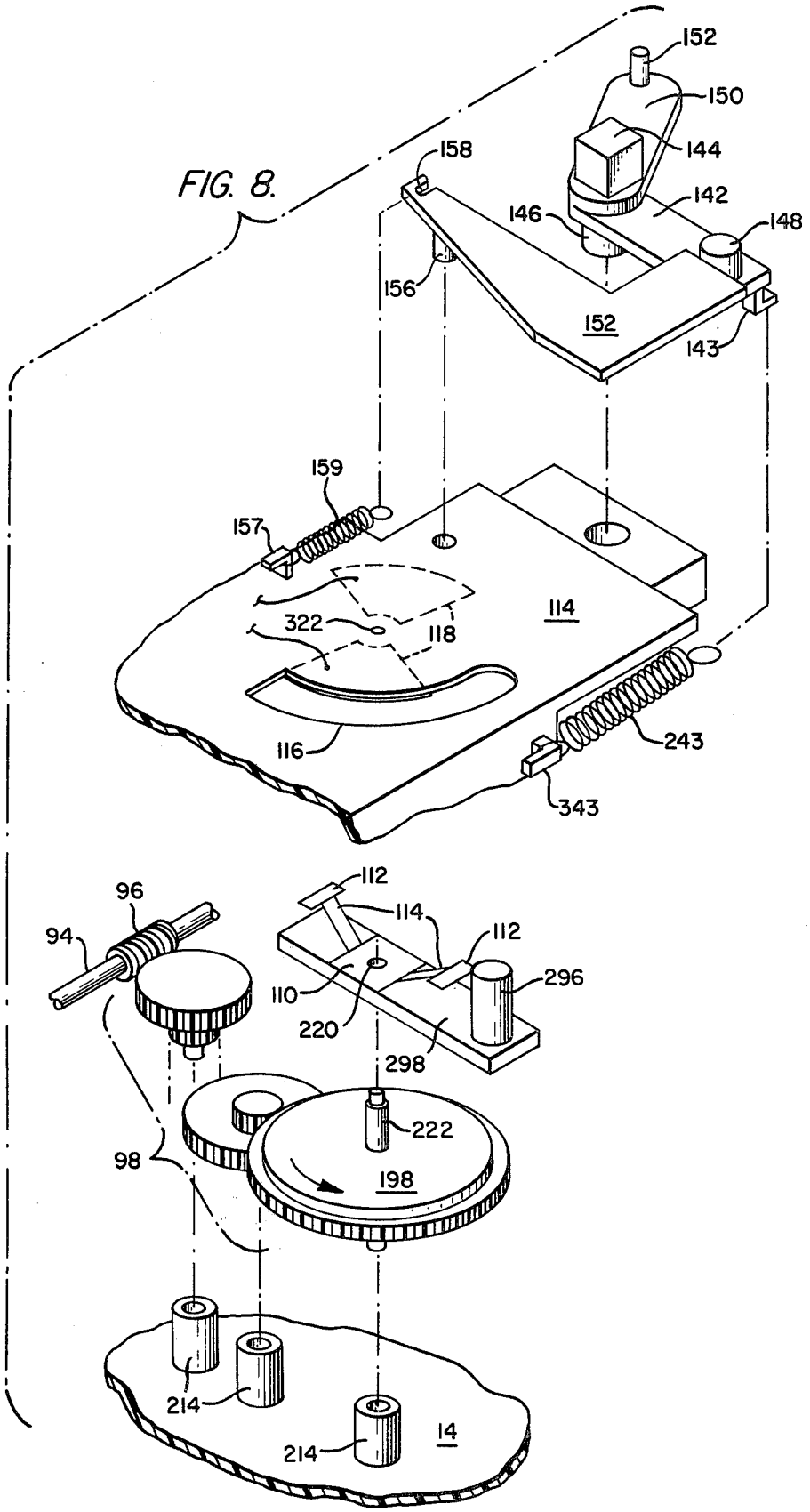
FIG. 8 is an exploded perspective view of the player actuated "shot" trigger mechanism and semiautomatic switch mechanism for effection energization of the motor.

Looking at FIGS. 8, 9, and 10, the player operated simulated drive shot actuating mechanism and semiautomatic energizing structure for the tape transport motor will now be described. The player operated lever 42 (FIG. 1) engages with a square projection 144 of a double actuating lever 142, 150. This double lever is of angular construction and the respective arms 142 and 150 are at approximately 135° from each other. At the junction of these arms, a pivot pin 146 is suitably mounted in an appropriate aperture in a subpanel 114 in the lower housing container 14. An actuating pin 148 is provided on the other end of arm 142 from the pivot pin 146 thereof. A spring 243 end attachment projection 143 is also provided on the end of arm 142. The other end of spring 243 is held by projection 343 on the subpanel 114. Suitably mounted underneath the inner surface of subpanel 114 are electrical conductive segments 118. These segments 118 are connected by appropriate wiring to the electric motor 17 and its energizing circuitry.

Looking at FIG. 2, the driven shaft 94 supports fixedly therewith a worm gear 96. This worm gear 96 in turn drives step down gearing 98 to slowly turn the friction drive support disc 198. The gearing 98 being appropriately pivotally mounted in axial support bosses 214 (FIG. 8). The friction drive support disc 198 has extending therefrom a shaft 222 upon which is mounted a bar 298 having a central aperture 220. The bar 298 has sufficient weight and coefficient of friction so that it will be normally rotated through its resting engagement with the upper surface of disc 198. A pin 296 is mounted on one end of bar 298 and electrical conductive member 110 having spring arms 114 and electrical contacts 112 is also mounted on said bar. When the pin 296 and bar 298 are orientated as shown in FIG. 8, the contacts 112 are in such a position that no electrical contact is made with the conducting segments 118. However, when the bar 298 and pin 296 are rotated in the clockwise direction, the electrical contacts 112 will complete a circuit between the contact segments 118 and thus energize the electric motor 17. The slot 116 in the subpanel 114 permits bar 298 and the pin 296 a limited rotation of approximately 90°The pin 296 is actuated by a pivot plate 152. Pivot plate 152 is pivotally mounted about the pin 156 supported in a suitable aperture in subpanel 114. A bar bias spring 159 is supported between projection 157 on the subchassis 114 and an appropriate spring end engaging groove 158 in pivot plate 152 to provide the normal non-conductive position of the pivot plate 152. When a player moves the drive shot lever 42 to the energized position, the shooting spring 243 will be tensioned, and then upon release of the lever 42, the shooting spring 243 will effect a sharp quick movement of pin 148 against the lower outer end of L-shaped pivot plate 152, and in turn cause the other end of the lower portion of pivot plate 152 to sharply strike pin 296 of the contact bar 298. Thus, upon each player shot, the energizing bar 298 will be rotated clockwise sufficiently enough to complete the circuit between contacts 112 and 118 and thus energize the electric motor. The worm gear 96 is rotated every time the motor 17 is energized and always in the same direction to effect a turning of the friction support disc 198 in the counter-clockwise direction indicated by the small arrow thereon. Thus, after every energization of the electric motor by a shot being made by a player, the motor will be energized for as long a time as it takes for the electric contact bar 298 to rotate back to the rest position thereof as indicated in FIG. 8 with the pin 296 at the right end of the curve slot 116. At this position the electric motor is again de-energized because the contacts 112 break circuit with the contact segments 118.

Figure 9:
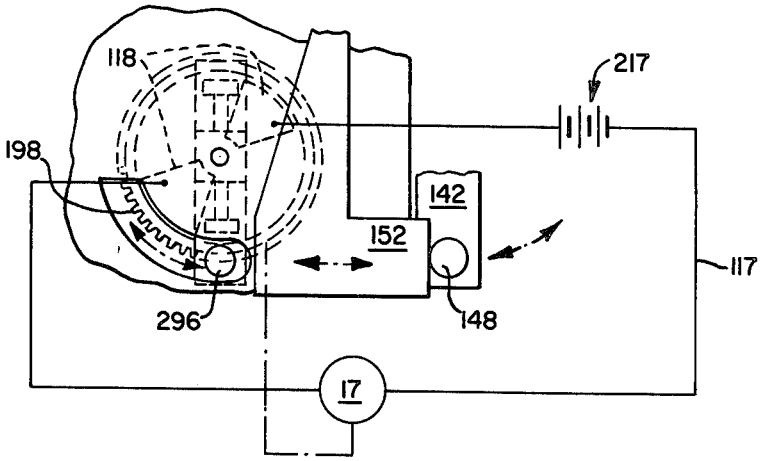
FIG. 9 is a schematic showing of the semiautomatic switch mechanism with electric circuit for the electric motor of the device.

FIG. 9 shows the electrical schematic for the above described operation. An electrical source, normally replaceable batteries, together with appropriate electric wiring 117 and the contact segments 118 are all shown in series with the electric motor 17. The arrows in this figure indicate the direction of movement of the pin 148 on player actuating lever 142, the movement of the lower end of the L-shaped pivot pin 152, and corresponding engagement and movement of the pin 296.

The golf ball replica 122 is mounted on the end of lever 120 pivotable about pivot pin 128. A suitable counterweight 121 is provided at the opposite end of lever 120. Also limit stops 123 and 125 are provided in the second subpanel 314. A bias spring 129 is mounted between spring end engaging projections 126 and 130 to suitably bias the lever 120 and golf ball replica 122 in the normal non-actuated position as shown in FIGS. 1 and 7. In this normal position the golf ball replica is aligned with and positioned slightly above the series of green driving tee off spots and green scoring holes.

Figure 10:
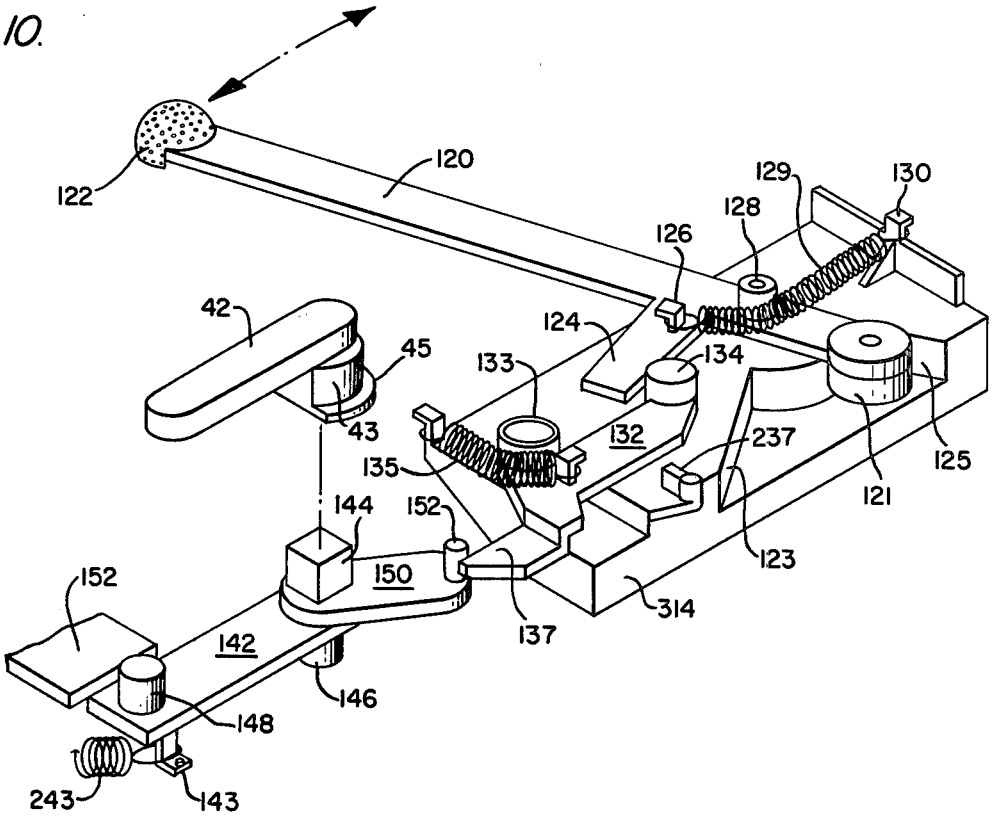
FIG. 10 is a perspective view of the imitation golf ball with pivotally mounted support lever and trigger actuating mechanism therefor.

As seen in FIG. 10, the second end of player actuating lever 142, 150 has a pin 152 mounted thereon. Every time the player lever 142 is moved counterclockwise to the cocked drive shot loaded position, and then released, lever 150 will swing sharply about pivot pin 146 and pin 152 will sharply strike the end 137 of pivot lever 132. The other end of pivot lever 132 has a striking end 134 for engagement with the projection 124 of golf ball replica pivot lever 120. A spring 135 normally biases the pivot member 132 in the clockwise direction so that the end 137 will normally rest against striking pin 152. Then when the player lever 42 is moved toward the cocked position, spring 135 will cause pivot member 132 to rotate clockwise until it reaches the stop 237 on subpanel 314. Upon release of the player lever 42, the spring 243 will effect a fast snap-like movement of actuating lever 142, 150 which will cause pin 152 to strike against the end 137 with a strong force to in turn cause pin 134 to sharply strike projection 124 of the golf ball replica lever. Thus, each time a player makes a drive shot by cocking the player lever and releasing same, the golf ball replica will be moved traversely of the program tape which has simultaneously been started in its movement because of the energization of electric motor 17 through the contact segments 118 and switch contacts 112 engaging as effected by the striking of pin 148 against the pivot plate 152.

The golf game device of this invention permits player controlled actuation of a simulated golf ball drive simultaneously with movement of a background program tape depicting various golf game scenes thereon. If a player overshoots a scoring green hole, the player then by actuation of the select bar can effect backward movement of the program tape to permit another forward shot as appropriate in an attempt to score. When the golf ball replica actually stops over a scoring hole, then the corresponding tape slot 338 for that hole will be in alignment with the electric lamp 38 contacts 138, 238 to effect lighting of the indicator lamp 38 to show that a score has been made. If two players are playing the game, they alternately take turns based upon each individual golf game driving tee and scoring hole scene. Just like in the real game of golf, the players obtaining the best score relative to the indicated par values is the winner.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A golf game device comprising:

a support structure;

a program tape mounted for movement traversely across said support structure and having depicted thereon various golf game scenes including green tee off spots, green scoring holes, and traps of various types;

actuating mechanism for moving said program tape;

a replica of a golf ball mounted for movement across the path of said program tape;

trigger mechanism associated with the golf ball replica and operable by a player of the game device for effecting the movement of said golf ball replica across the tape path;

an indicator means associated with the program tape for signalling a score as simulated by the positioning of the golf ball replica over a green scoring hole on said program tape.

2. A golf game device as in claim 1, wherein said actuating mechanism for moving the program tape includes a pair of spools mounted upon said support structure;

said program tape movement being effected by it being wound from one spool to the other in a back and forth manner;

drive mechanism connected with said actuating mechanism for operating same and a player operated control for controlling the direction of operating of said drive mechanism and thus the direction of movement of said program tape.

3. A golf game device as set forth in claim 2, wherein said actuating mechanism further includes an electric motor for driving same;

associated wiring and a source of electrical energy for said electric motor, player operated means for connecting said electrical energy to said electric motor during playing of the game device; said trigger mechanism for effecting movement of said golf ball replica associated with switch means connected with the wiring for energizing the electric motor to drive the program tape moving mechanism for a short amount of time to simulate the drive of a golf ball over a given distance as depicted on the program tape;

and driven means for automatically disengaging said switch means in order to de-energize the electric motor and stop the program tape movement.

4. A golf game device as in claim 3, wherein said indicator means includes an electric bulb, switch contacts between which a portion of the program tape passes during movement thereof for the purpose of normally separating said switch contacts, a plurality of slots provided in said program tape with a slot corresponding to and in alignment with each depiction of a green scoring hole so that each time the replica of a golf ball moves over a green scoring hole on the tape an associated slot in alignment therewith will permit the closing of said switch contacts in order to energize the electric bulb.

5. A golf game device as in claim 1, wherein said indicator means includes an electric bulb, switch contacts between which a portion of the program tape passes during movement thereof and for the purpose of normally separating said switch contacts, a plurality of slots provided in said program tape and a slot corresponding to and in alignment with each depiction of a green scoring hole so that each time the replica of a golf ball moves over a green scoring hole on the tape an associated slot in alingment therewith will permit the closing of said switch contacts in order to energize the electric bulb to indicate a score has been made.

6. A golf game device for simulating the playing action of the game of golf comprising:

a housing having a viewing window mounted therein;

first and second supply/take-up spools rotatably mounted in said housing;

an electric motor;

player controlled reversible spool drive mechanism driven by said electric motor for driving one or the other of said first and second supply/take-up spools;

a flexible member of substantial width relative to the housing and having each of the respective ends thereof attached to the respective first and second supply/take-up spools for the purpose of winding said flexible member upon one of said spools while unwinding from the other of said spools;

said flexible member having a plurality of golf course scenes depicted thereon, said scenes including a plurality of associated green driving tee spots and scoring holes;

a swinging member pivotally mounted in said housing and having at one end a replica of a golf ball and at the other end an actuating lever;

player operated means for effecting a swinging movement of said pivotally mounted swinging member through contact with said actuating lever;

semiautomatic means for effecting energization of said electric motor simultaneously with the effecting of the swinging movement of said pivotal member; and said semiautomatic means including mechanism driven by said electric motor to effect de-energization of said electric motor after a desired time sequence of operation of the device has occurred.

7. A golf game device as in claim 6, further including slots provided in said flexible member and in correspondence and alignment with the greens scoring holes as depicted on said flexible member;

spring biased switch contacts mounted in said housing and associated with said flexible member so as normally to be separated thereby and being mounted in alignment with the slots so as to permit closing of the switch contacts when the flexible member moves so that a slot arrives at the switch contacts in order to permit closure of the switch contacts, and an electric bulb connected to the switch contacts in series with a power source in order to be energized each time a slot associated scoring hole is in a predetermined position within said housing.

8. A golf game device as in claim 7, together with a manual switch for energizing said electric motor under the control of a player for the purpose of effecting a desired movement of the flexible member under direct player control; at least one manually actuated scoring mechanism provided with said housing for recording the number of player shots with respect to a par value as indicated with each golf green scene as being currently played by a player of the device; a slip clutch between said electric motor and the supply/take-up spool drive mechanism to prevent motor burn out in case of malfunction of the mechanism;

and a bias spring connected to said pivotally mounted swinging member for normally maintaining said member in a rest position in alignment with driving tee spots and scoring holes as depicted on the movable flexible member.

9. A simulated golf game playing structure for two players comprising:

a support housing having a lower container portion and an upper container portion;

said upper container portion having a relatively large viewing aperture provided therein and a plurality of manually controlled mechanisms readily accessible by a player thereon;

said lower container portion having a pair of spools rotatably supported therein at substantially opposite ends thereof;

an electric motor;

a reversible drive mechanism between said electric motor and said pair of spools;

a flexible program tape supported between said pair of spools and being unwound from one of said spools and wound upon the other to effect one direction of movement of said program tape, and vis-a-vis to effect the opposite direction of movement of said program tape;

1 said program tape having various golf scenes depicted thereon including at least driving tee spots and scoring holes;

a golf ball replica movably mounted in alignment with and associated with said movable program tape and mounted on said lower container portion so as normally to be in alignment with respective driving tee spots and scoring holes when in a normally at rest first position;

player operated actuating mechanism for effecting movement of said golf ball replica across the path of movement of said program tape;

semi-automatic mechanism simultaneously actuatable from said player operated mechanism for effecting energization of said electric motor for a short period of time which varies with the amount of manual input by a player of the device;

manual mechanism connected to said spool drive mechanism for player control of the direction of program tape movement; and a light display means for indicating a simulated scoring of the golf ball replica into a green scoring hole.

10. A golf game device as in claim 9, wherein said light display means includes slots in the program tape provided in alignment with each green scoring hole as depicted thereon;

an electric bulb positioned on the lower container portion beneath the program tape;

electric switch controls associated with said tape and the slots therein for effecting energization of said electric bulb whenever a simulation of the golf ball scoring in a hole occurs;

and bias means for said golf ball replica mechanism with limit stops so as normally to maintain said golf ball replica in alignment over a tee spot and a scoring hole whenever the golf ball supporting member is not being actuated.

11. A golf game device as in claim 10, wherein a spring effected snapping lever is included with the player operated actuating mechanism for effecting movement of the golf ball depicting member whenever the player control is released from a previously moved position as inscribed on the upper container portion; a manual slide for player control to determine the direction of movement of said flexible program tape provided with a control knob extending above the upper container portion and associated with appropriate indicia thereon for player interpretation; said flexible program tape including an inscription associated with each combination of green tee spots and scoring holes of the pre-supposed distance between them and an appropriate par value for that particular golf scene being depicted;

and two manually operated scoring mechanisms mounted on the upper container member for separate player recording of each individual score as compared with the preindicated par for each particular golf scene.

* * * * *